US009135866B2

(12) United States Patent
Nakamura et al.

(10) Patent No.: US 9,135,866 B2
(45) Date of Patent: Sep. 15, 2015

(54) DISPLAY APPARATUS AND CONTROL METHOD THEREOF

(75) Inventors: Koki Nakamura, Tokyo (JP); Atsushi Mizutome, Miura-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 206 days.

(21) Appl. No.: 13/587,553

(22) Filed: Aug. 16, 2012

(65) Prior Publication Data

US 2013/0050240 A1 Feb. 28, 2013

(30) Foreign Application Priority Data

Aug. 23, 2011 (JP) ..... 2011-181198

(51) Int. Cl.

| | |
|---|---|
| ***G09G 5/10*** | (2006.01) |
| ***G09G 3/34*** | (2006.01) |
| ***G09G 3/36*** | (2006.01) |
| *G09G 3/20* | (2006.01) |

(52) U.S. Cl.

CPC ..... *G09G 3/342* (2013.01); *G09G 3/3611* (2013.01); *G09G 3/2022* (2013.01); *G09G 3/3426* (2013.01); *G09G 2320/0209* (2013.01); *G09G 2320/064* (2013.01); *G09G 2320/0633* (2013.01); *G09G 2320/0646* (2013.01); *G09G 2360/16* (2013.01)

(58) Field of Classification Search

CPC ..... G09G 2360/16; G09G 2320/0646; G09G 3/3406; G09G 2320/0271; G09G 2320/0633; G09G 2320/064

USPC ..... 345/77, 89, 102, 690, 589; 349/61

See application file for complete search history.

(56) References Cited

U.S. PATENT DOCUMENTS

| | | | | |
|---|---|---|---|---|
| 6,094,243 | A * | 7/2000 | Yasunishi | 349/33 |
| 7,576,722 | B2 * | 8/2009 | Tseng | 345/89 |
| 2003/0006952 | A1 * | 1/2003 | Hong | 345/89 |
| 2004/0246275 | A1 * | 12/2004 | Yoshihara et al. | 345/690 |
| 2005/0162360 | A1 * | 7/2005 | Ishihara et al. | 345/89 |
| 2006/0164379 | A1 * | 7/2006 | Oh et al. | 345/102 |
| 2008/0111835 | A1 * | 5/2008 | Hu | 345/690 |
| 2008/0284719 | A1 * | 11/2008 | Yoshida | 345/102 |

(Continued)

FOREIGN PATENT DOCUMENTS

| | | |
|---|---|---|
| JP | 2008-009396 | 1/2008 |
| JP | 2008-020549 | 1/2008 |

(Continued)

OTHER PUBLICATIONS

Jun. 2, 2015 Japanese Office Action, which is enclosed without an English Translation, that issued in Japanese Patent Application No. 2011-181198.

*Primary Examiner* — Koosha Sharifi-Tafreshi

(74) *Attorney, Agent, or Firm* — Cowan, Liebowitz & Latman, P.C.

(57) ABSTRACT

A display apparatus, according to the present invention, that displays an image by causing a backlight to emit light at an emission brightness value in accordance with brightness of the image, the display apparatus comprises: an input unit that inputs an image signal; a division unit that divides one frame period into a plurality of sub-frame periods when one frame of the image signal includes a plurality of images having different brightness; and a display controlling unit that performs control of switching between the plurality of images for each sub-frame period and displaying the images.

16 Claims, 14 Drawing Sheets

(56) References Cited

U.S. PATENT DOCUMENTS

| | | | | |
|---|---|---|---|---|
| 2008/0297463 | A1* | 12/2008 | Tsuru et al. | 345/102 |
| 2009/0115719 | A1* | 5/2009 | Lin et al. | 345/102 |
| 2009/0121987 | A1* | 5/2009 | Fukutome et al. | 345/82 |
| 2009/0122207 | A1* | 5/2009 | Inoue et al. | 348/739 |
| 2010/0245398 | A1* | 9/2010 | Amino | 345/690 |

FOREIGN PATENT DOCUMENTS

| | | | |
|---|---|---|---|
| JP | 2009-294599 | A | 12/2009 |
| JP | 2010-002898 | A | 1/2010 |

* cited by examiner

FIG. 12A

| | | |
|---|---|---|
| 1 | 3 | 1 |
| 2 | 4 | 2 |

FIG. 12B

| | | |
|---|---|---|
| 1 | 3 | 2 |
| 2 | 4 | 1 |

DISPLAY APPARATUS AND CONTROL METHOD THEREOF

BACKGROUND OF THE INVENTION

1. Field of the Invention

The present invention relates to a display apparatus and a control method thereof.

2. Description of the Related Art

In recent years, liquid crystal display apparatuses have been getting larger in size and higher in definition and an opportunity of concurrently displaying a plurality of images on one screen has increased. There is provided a liquid crystal display apparatus capable of adjusting an emission brightness value of a backlight for each area.

Examples of the method of concurrently displaying a plurality of images having different brightness on one screen includes a method of controlling transmittance of a liquid crystal element for each area of the image and a method of controlling the emission brightness value of the backlight for each area of the image.

In the method of controlling the transmittance of the liquid crystal element for each area of the image, for example, when both a bright image and a dark image are displayed concurrently, the entire emission brightness value of the backlight is determined based on the bright image. An upper limit value of transmittance of the dark image is decreased based on the determined emission brightness value.

In the method of controlling the emission brightness value of the backlight for each area of the image, for example, when both the bright image and the dark image are displayed concurrently, the emission brightness value of the backlight is determined to be high in the area of the bright image and low in the area of the dark image.

A control method of the transmittance of the liquid crystal element or the emission brightness value of the backlight is disclosed in, for example, Japanese Patent Application Laid-Open Nos. 2008-9396 and 2008-20549.

SUMMARY OF THE INVENTION

However, in the method of controlling the transmittance of the liquid crystal element for each area of the image, a dynamic range of the liquid crystal element cannot be maximally used. For example, as de scribed above, when the emission brightness value of the backlight is determined based on the bright image and the upper limit of the transmittance of the dark image is decreased, the dynamic range of the liquid crystal element cannot be maximally used with respect to the dark image. In the method of controlling the emission brightness value of the backlight for each area of the image, light from the backlight in an area of each image may interfere and a display may be inaccurate in a boundary portion between the images by diffusion of the light from the backlight.

Therefore, the present invention provides a technology that can maximally use the dynamic range of a display element for each image and accurately display each image when a frame including the plurality of images is displayed on one screen.

A display apparatus, according to the present invention, that displays an image by causing a backlight to emit light at an emission brightness value in accordance with brightness of the image, the display apparatus comprises:

an input unit that inputs an image signal;

a division unit that divides one frame period into a plurality of sub-frame periods when one frame of the image signal includes a plurality of images having different brightness; and a display controlling unit that performs control of switching between the plurality of images for each sub-frame period and displaying the images.

A control method, according to the present invention, of a display apparatus that displays an image by causing a backlight to emit light at an emission brightness value in accordance with brightness of the image, the method comprises:

an input step of inputting an image signal;

a division step of dividing one frame period into a plurality of sub-frame periods when one frame of the image signal includes a plurality of images having different brightness; and a display controlling step of performing a control of switching between the plurality of images for each sub-frame period and displaying the images.

According to the embodiments of the present invention, the dynamic range of a display element can be maximally used for each image and each image can be accurately displayed when a frame including the plurality of images is displayed on one screen.

Further features of the present invention will become apparent from the following description of exemplary embodiments with reference to the attached drawings.

BRIEF DESCRIPTION OF THE DRAWINGS

FIGS. 12A and 12B are diagrams illustrating one example of a method of classifying an image group according to the third embodiment;

DESCRIPTION OF THE EMBODIMENTS

First Embodiment

Hereinafter, a display apparatus and a control method thereof according to a first embodiment of the present invention will be described with reference to the accompanying drawings. The display apparatus (for example, the liquid crystal display apparatus) according to the embodiment displays an image by making a backlight emit light with an emission brightness value depending on brightness (luminance) of the image.

Figure 1:
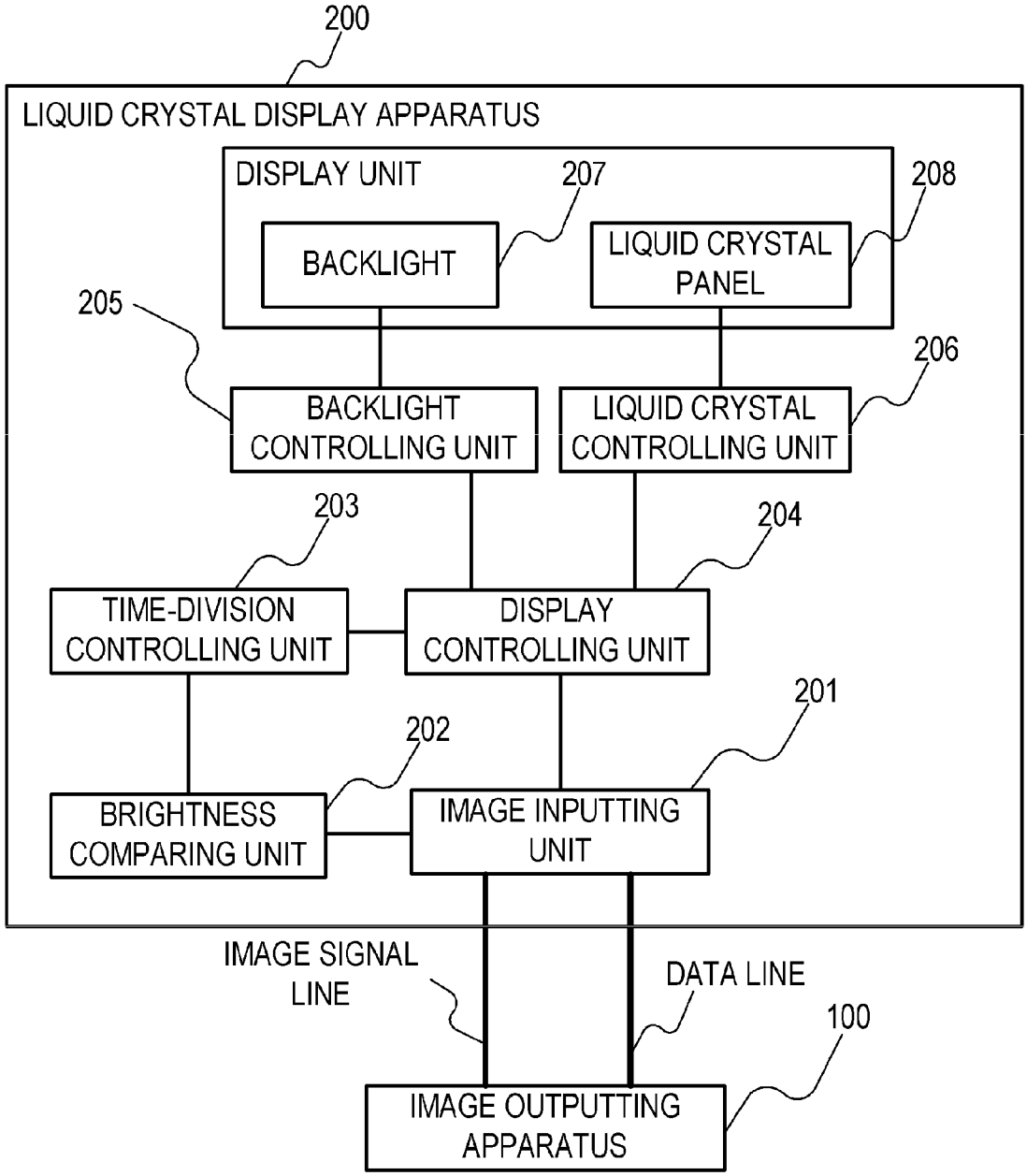
FIG. 1 is a block diagram illustrating one example of a schematic configuration of a liquid crystal display apparatus according to a first embodiment.

FIG. 1 is a block diagram illustrating one example of a schematic configuration of a liquid crystal display apparatus according to a first embodiment.

As illustrated in FIG. 1, the liquid crystal display apparatus 200 is connected to an image outputting apparatus 100. The liquid crystal display apparatus 200 includes an image inputting unit 201, a brightness comparing unit 202, a time-division controlling unit 203, a display controlling unit 204, a backlight controlling unit 205, a liquid crystal controlling unit 206, a backlight 207, and a liquid crystal panel 208.

The image outputting apparatus 100 sends an image signal (an image signal for one frame) to the image inputting unit 201 in the liquid crystal display apparatus 200 through an image signal line. The image outputting apparatus 100 sends a display brightness setting value and display area information to the image inputting unit 201 in the liquid crystal display apparatus 200 through a data line.

The display brightness setting value is a value indicating brightness of an image. When the image signal for one frame is a signal of a frame including a plurality of images, the value indicating the brightness of the image is sent from the image outputting apparatus 100 to the image inputting unit 201 as the display brightness setting value for each image. The display brightness setting value is, for example, an emission brightness value of a backlight, and the like.

The display area information is information indicating an area (a display area) of the image. When the image signal for one frame is the signal of the frame including the plurality of images, the information indicating the display area of the image is sent from the image outputting apparatus 100 to the image inputting unit 201 as the display area information for each image. The display area information is, for example, a positional coordinate (x, y) of a pixel of each vertex (an upper left point, an upper right point, a lower left point, or a lower right point of the image) of the image. A value of the x coordinate indicates a horizontal position on a screen and a value of the y coordinate indicates a vertical position on the screen.

Next, an operation (processing) of each functional block of the liquid crystal display apparatus 200 will be described.

The image inputting unit 201 inputs the image signal for one frame. In detail, the image inputting unit 201 receives the image signal, the display brightness setting value, and the display area information from the image outputting apparatus 100. The image inputting unit 201 transmits the received display brightness setting value to the brightness comparing unit 202. The image inputting unit 201 transmits the received image signal, the display brightness setting value, and the display area information to the display controlling unit 204.

The brightness comparing unit 202 receives the display brightness setting value from the image inputting unit 201. The brightness comparing unit 202 calculates the number of different display brightness setting values (the number of brightnesses of the images included in the inputted image signal) from the received display brightness setting value.

Hereinafter, a method of calculating the number n of different display brightness setting values by the brightness comparing unit 202 will be described.

First, the brightness comparing unit 202 judges the number a of the received display brightness setting values (the number of images included in the inputted frame).

Next, the brightness comparing unit 202 selects two display brightness setting values from the received display brightness setting value for comparison.

The brightness comparing unit 202 calculates a difference between the selected two display brightness setting values. When there is the difference between the two display brightness setting values (when the calculated difference is not 0), the brightness comparing unit 202 judges that brightnesses of two images having the two display brightness setting values is different. The brightness comparing unit 202 adds 0 to the number b (the number of images having the same brightness as the brightness of the other image) of the same display brightness setting values as the display brightness setting value of the other image. When there is no difference between the two display brightness setting values (when the calculated difference is 0), the brightness comparing unit 202 judges that the brightnesses of two images having the two display brightness setting values is the same. The brightness comparing unit 202 adds 1 to the number b. An initial value of the number b is 0.

The brightness comparing unit 202 calculates the difference and updates the number b with respect to all combinations of the two display brightness setting values. For example, in the case where the number a is 4, the brightness comparing unit 202 calculates the difference and updates the number b with respect to (4-1)!, that is, six combinations.

After the calculation of the difference and the updating of the number b are terminated with respect to all the combinations, the brightness comparing unit 202 calculates a value of (a−b) as the number n (the number of brightnesses of the images included in the inputted frame) of different display brightness setting values. The brightness comparing unit 202 transmits the number n to the time-division controlling unit 203.

In the embodiment, when the difference in the display brightness setting value between the images is 0, it is judged that the brightnesses of the images are the same as each other, but the judgment is not limited thereto. For example, when the difference in the display brightness setting value between the images is less than a predetermined value, it may be judged that the brightnesses of the images are the same as each other.

The time-division controlling unit 203 divides one frame period into a plurality of (the number of brightnesses) sub-frame periods when the image signal for the inputted one frame is a signal of a frame including a plurality of images having different brightness (including images having a plurality of brightnesses). In detail, the time-division controlling unit 203 receives the number n of the different display brightness setting values from the brightness comparing unit 202. The time-division controlling unit 203 generates a time-division synchronization signal for dividing one frame period into n sub-frame periods. The time-division controlling unit 203 transmits the time-division synchronization signal to the display controlling unit 204.

The plurality of images having the different brightness are switched and displayed for each sub-frame period by the display controlling unit 204, the backlight controlling unit 205, and the liquid crystal controlling unit 206. When the inputted frame includes (a plurality of) images having the same brightness, the images having the same brightness is displayed during one sub-frame period. In the embodiment, an entire area of the backlight emits light at the emission brightness value in accordance with the brightness of the image to display the image.

In detail, the display controlling unit 204 receives the image signal, the display brightness setting value, and the display area information from the image inputting unit 201. The display controlling unit 204 receives the time-division synchronization signal from the time-division controlling unit 203. The display controlling unit 204 allocates n display brightness setting values (n different display brightness setting values among the received display brightness setting values) to n sub-frame periods (an n-th sub-frame period from a first sub-frame period) divided by the time-division synchronization signal. The display controlling unit 204 generates a display image signal that allows an image corresponding to, during a sub-frame period, a display brightness setting value allocated to the sub-frame period to be displayed in an area designated by display area information corresponding to the image and a black color to be displayed in an area other than the corresponding area. The display controlling unit 204 transmits the generated display image signal to the liquid crystal controlling unit 206 and transmits the display brightness setting value corresponding to the image displayed by the display image signal to the backlight controlling unit 205, during the sub-frame period.

The backlight controlling unit 205 receives the display brightness setting value from the display controlling unit 204 during the sub-frame period. The backlight controlling unit 205 makes an entire area (an entire surface) of the backlight 207 emits light with an emission brightness value depending on the received display brightness setting value.

The liquid crystal controlling unit 206 receives a display image signal from the display controlling unit 204 during the sub-frame period. The liquid crystal controlling unit 206 drives the liquid crystal panel 208 (controls transmittance of each display element (liquid crystal element) of the liquid crystal panel 208) according to the display image signal.

Light from the backlight 207 transmits the liquid crystal panel 208 to thereby display the image.

Figure 2:
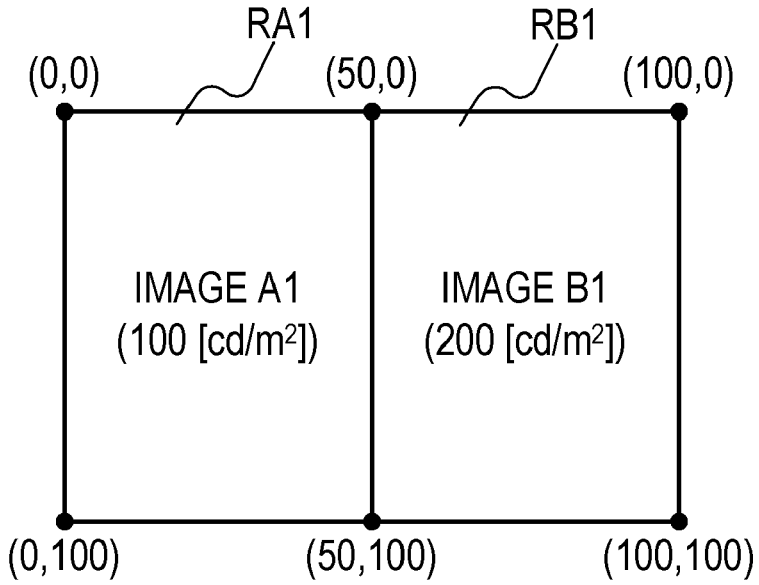
FIG. 2 is a diagram illustrating one example of an image signal, a display brightness setting value, and display area information.

FIG. 2 is a diagram illustrating one example of an image signal, a display brightness setting value, and display area information which are inputted. In the example of FIG. 2, the image signal is a signal of a frame including two images A1 and B1 which are aligned in a horizontal direction (in a horizontal direction of the screen). The image A1 is an image displayed in an area RA1 occupying a left half part of the screen and the image B1 is an image displayed in an area RB1 occupying a right half part of the screen. In the example of FIG. 2, a display brightness setting value of the image A1 is 100 cd/m$^2$ and a display brightness setting value of the image B1 is 200 cd/m$^2$. Display area information of the image A1 is four edge coordinates (0,0), (50,0), (0,100), and (50,100) of the area RA1. Display area information of the image B1 is four edge coordinates (50,0), (100,0), (50,100), and (100, 100) of the area RB1.

Figure 3:
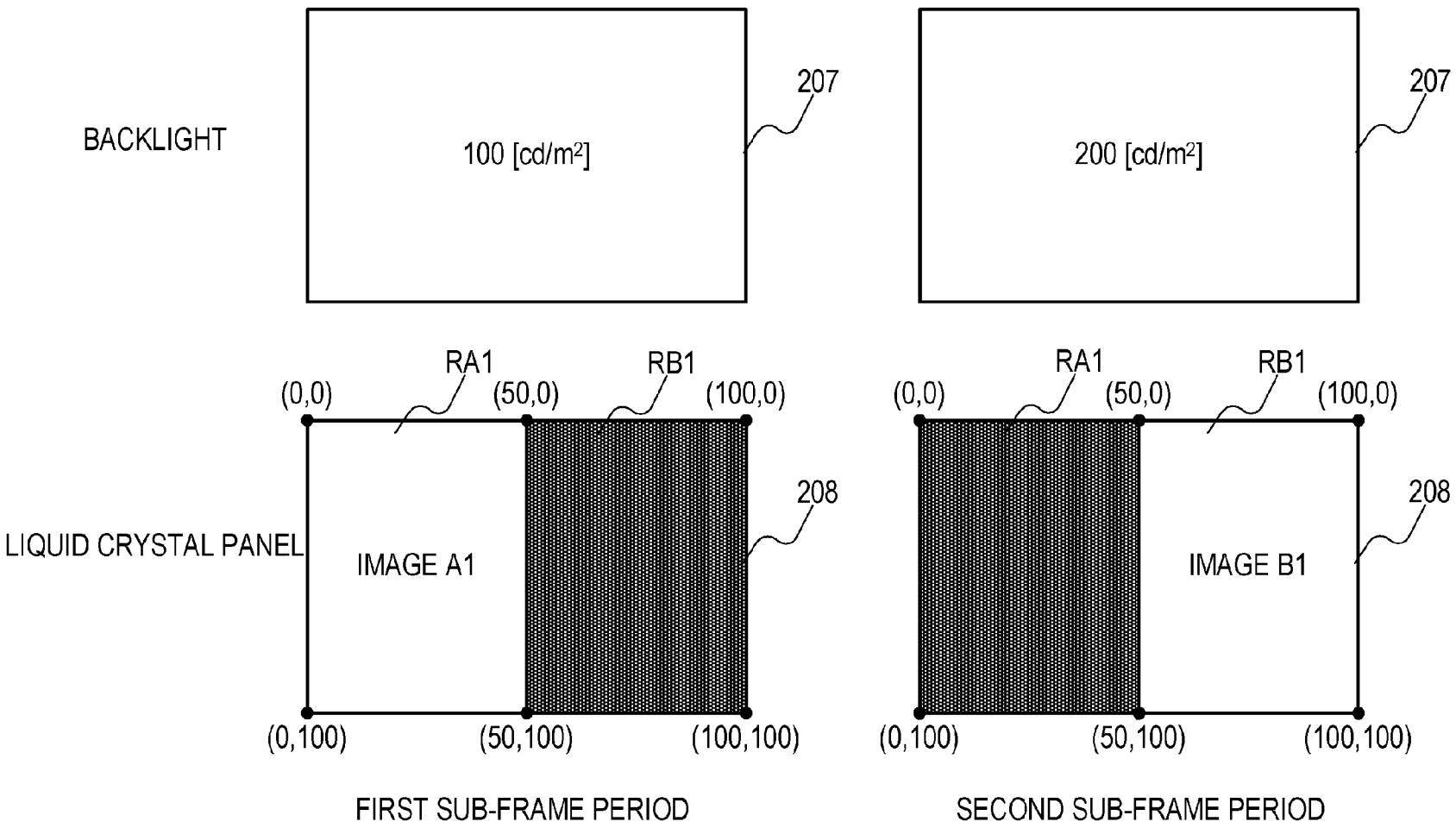
FIG. 3 is a diagram illustrating one example of a display image of the liquid crystal display apparatus according to the first embodiment.
Figure 4:
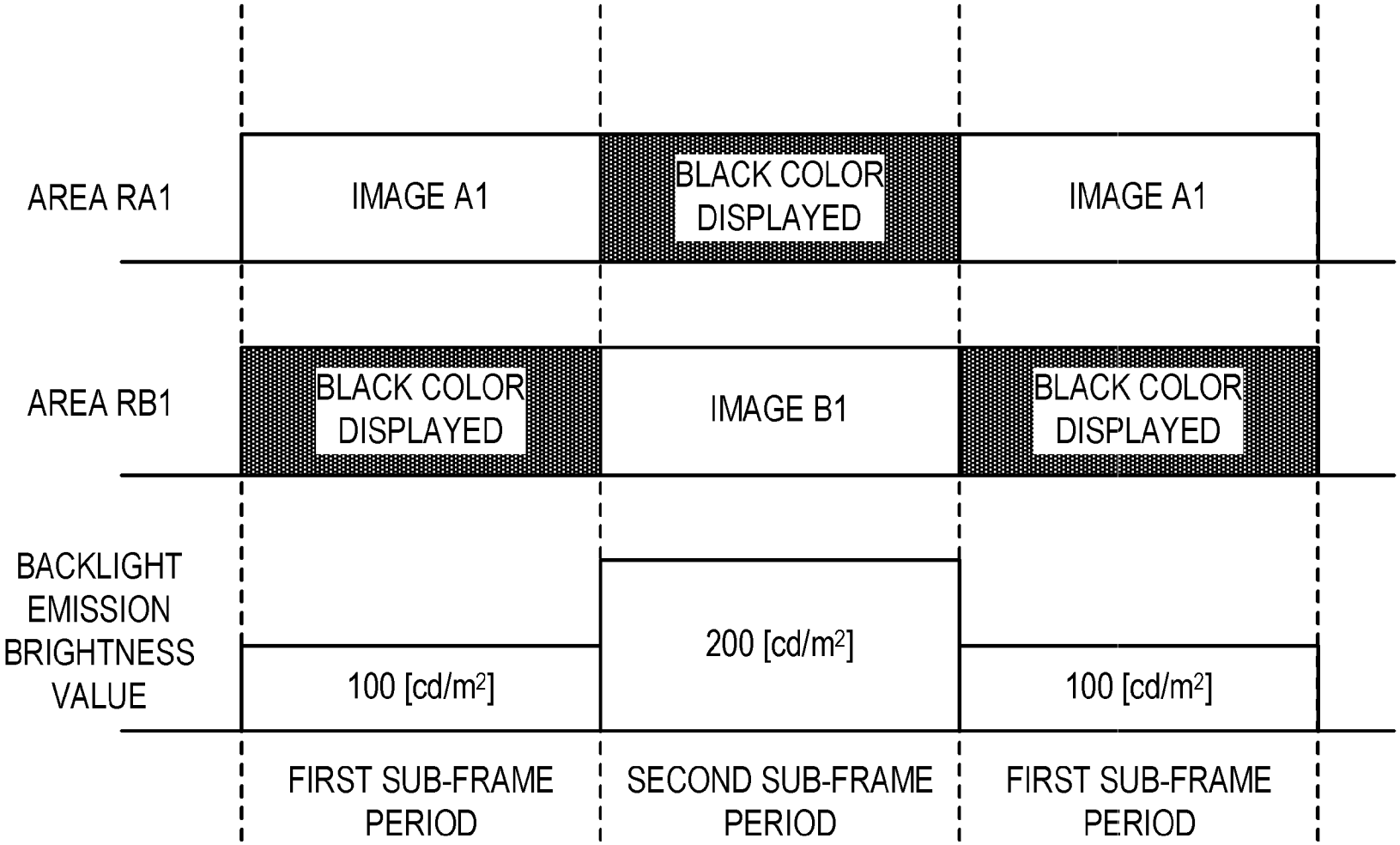
FIG. 4 is a time chart illustrating one example of an operation of the liquid crystal display apparatus according to the first embodiment.

When the image signal, the display brightness setting value, and the display area information of FIG. 2 are inputted, the number n of different display brightness setting values is 2, and one frame period is divided into two periods of a first sub-frame period and a second sub-frame period as illustrated in FIGS. 3 and 4. In the embodiment, a refresh rate (the number of display times of the image (frame) per one second) of a display unit (the backlight 207 and the liquid crystal panel 208) is set to 60 Hz and the length during one frame period is set to 16.66 ms. Therefore, both the lengths of the first sub-frame period and the second sub-frame period are 8.33 ms.

The image A1 is displayed in the area RA1 and the black color is displayed in the area RB1 during the first sub-frame period. In this case, the emission brightness value of the backlight is 100 cd/m$^2$ which is the display brightness setting value of the displayed image A1.

The black color is displayed in the area RA1 and the image B1 is displayed in the area RB1 during the second sub-frame period. In this case, the emission brightness value of the backlight is 200 cd/m$^2$ which is the display brightness setting value of the displayed image B1.

Figure 5:
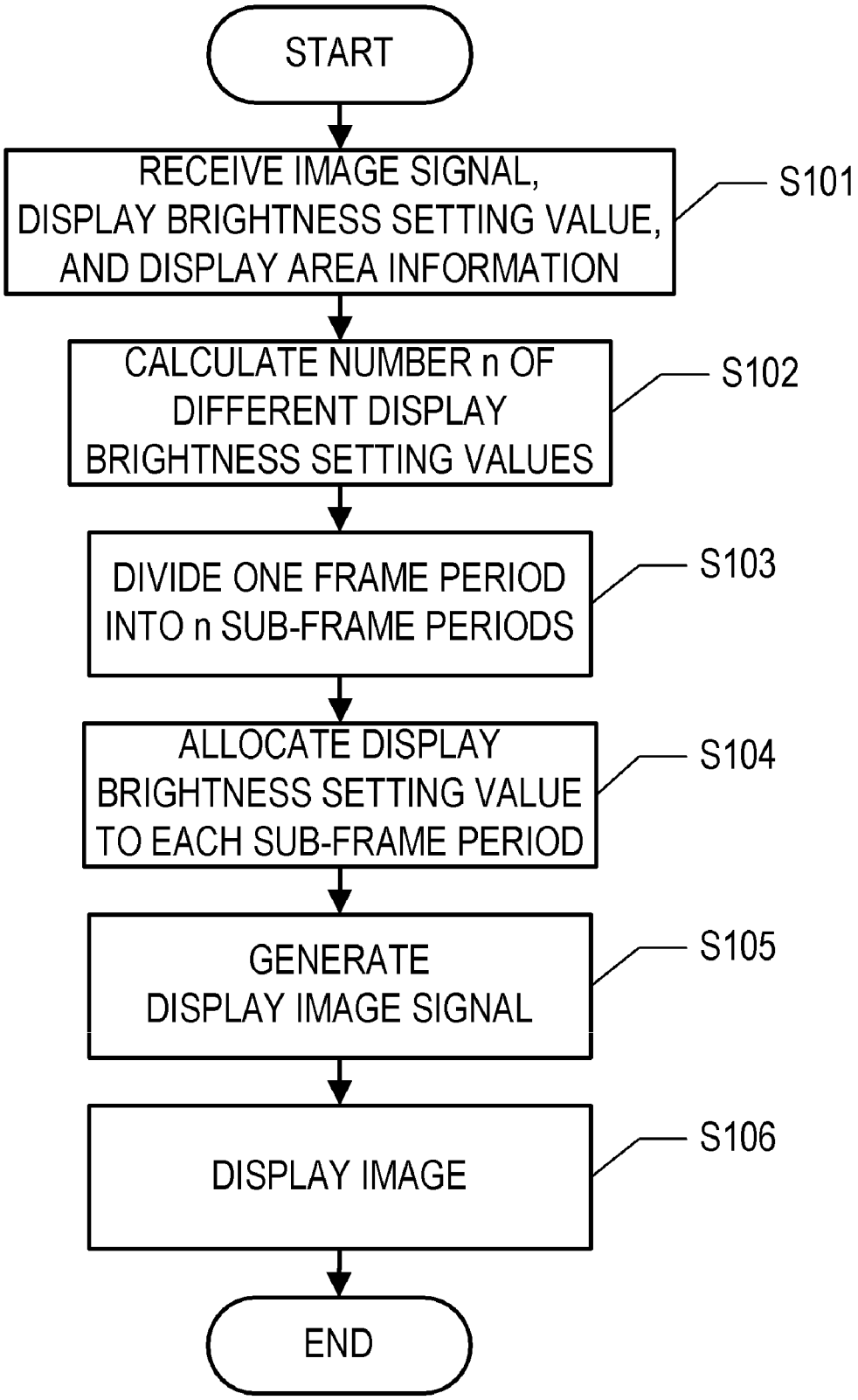
FIG. 5 is a flowchart illustrating one example of an operation of the liquid crystal display apparatus according to the first embodiment.

When the image signal, the display brightness setting value, and the display area information of FIG. 2 are inputted, an operation of the liquid crystal display apparatus 200 will be described by using a flowchart of FIG. 5.

In step S101, the image inputting unit 201 receives the image signal through the image signal line and receives the display brightness setting value and the display area information through a data line, from the image outputting apparatus 100. The image inputting unit 201 transmits the received display brightness setting value to the brightness comparing unit 202 and transmits the received image signal, display brightness setting value, and display area information to the display controlling unit 204.

In step S102, the brightness comparing unit 202 receives the display brightness setting value from the image inputting unit 201. The brightness comparing unit calculates the number n of different display brightness setting values from the received display brightness setting value and transmits the calculation result (the number n) to the time-division controlling unit 203.

The processing of step S102 will be described in detail.

First, the brightness comparing unit 202 receives the display brightness setting value of the image A1 and the display brightness setting value of the image B1 as the display brightness setting value and judges that the number a of the received display brightness setting values is 2.

Next, the brightness comparing unit 202 judges that a combination of two display brightness setting values is one type (a combination of the display brightness setting value of the image A1 and the display brightness setting value of the image B1) because a is 2. The brightness comparing unit 202 calculates a difference between two display brightness setting values of the combination thereof with respect to the one type of combination. That is, a difference between the display brightness setting value of the image A1 and the display brightness setting value of the image B1 is calculated. Herein, the difference between the display brightness setting value of the image A1 and the display brightness setting value of the image B1 is 100 cd/m$^2$ (alternatively, −100 cd/m$^2$)≠0. As a result, the brightness comparing unit 202 adds 0 to the number b of the same display brightness setting value as the display brightness setting value of the other image.

The brightness comparing unit 202 calculates the number n of different display brightness setting values which is 2 at (a−b)=2−0 and transmits the calculation result (the number n of different display brightness setting values is 2) to the time-division controlling unit 203.

In step S103, the time-division controlling unit 203 receives the number n of the different display brightness setting values which is 2 from the brightness comparing unit 202. The time-division controlling unit 203 generates a time-division synchronization signal for dividing one frame period into two sub-frame periods. In detail, the time-division synchronization signal for dividing one frame period into the first sub-frame period and the second sub-frame period in which each length is ½ shorter than the length of the frame period is generated. Herein, the first sub-frame period is ½ shorter than the length of a frame period before being divided using a starting point of the frame period before being divided as a starting point. The second frame period uses an ending point of the first sub-frame period as the starting point and uses an ending point of the frame period before being divided as the ending point. The time-division controlling unit 203 transmits the time-division synchronization signal to the display controlling unit 204.

In step S104, the display controlling unit 204 receives the image signal, the display brightness setting value, and the display area information from the image inputting unit 201. The display controlling unit 204 receives the time-division synchronization signal from the time-division controlling unit 203. The display controlling unit 204 allocates the display brightness setting value of 100 cd/m$^2$ to the first sub-frame period and the display brightness setting value of 200 cd/m$^2$ to the second sub-frame period. That is, the display period of the image A1 having the display brightness setting value of 100 cd/m$^2$ becomes the first sub-frame period and the display period of the image B1 having the display brightness setting value of 200 cd/m$^2$ becomes the second sub-frame period.

In step S105, the display controlling unit 204 generates a display image signal that allows the image A1 to be displayed in the area (the left half part of the screen) designated by the display area information corresponding to the image A1 and the black color to be displayed in the area other than the corresponding area, during the first sub-frame period. The display controlling unit 204 transmits the generated display image signal to the liquid crystal controlling unit 206 and transmits the display brightness setting value of 100 cd/m$^2$ corresponding to the image A1 to the backlight controlling unit 205, during the first sub-frame period.

A display image signal that allows the image B1 to be displayed in the area (the right half part of the screen) designated by the display area information corresponding to the image B1 and the black color to be displayed in the area other than the corresponding area, during the second sub-frame period, is generated. During the second sub-frame period, the generated display image signal is transmitted to the liquid crystal controlling unit 206 and the display brightness setting value of 200 cd/m$^2$ corresponding to the image B1 is transmitted to the backlight controlling unit 205.

In step S106, the backlight controlling unit 205 makes all the areas of the backlight emit light at the emission brightness value in accordance with the display brightness setting value transmitted from the display controlling unit 204. For example, when the display brightness setting value of 100 cd/m$^2$ is transmitted, the emission brightness values of all the areas of the backlight are 100 cd/m$^2$.

The liquid crystal controlling unit 206 drives the liquid crystal panel according to the display image signal transmitted from the display controlling unit 204.

As a result, the image A1 is displayed in the left half part of the screen and the black color is displayed in the other area, during the first sub-frame period. The image B1 is displayed in the right half part of the screen and the black color is displayed in the other area, during the second sub-frame period.

As described above, according to the embodiment, when the image signal is the signal of the frame including the plurality of images having different brightness, one frame period is divided into the plurality of sub-frame periods and the plurality of images are switched and displayed for each sub-frame period. As a result, a frame including the plurality of images having different brightness is displayed during one frame period. According to the embodiment, the transmittance of the liquid crystal element is not limited, and the image is displayed by making the backlight emit light at the emission brightness value in accordance with the brightness of the image. As a result, a dynamic range of the display element (liquid crystal element) can be maximally used at the time of displaying the image. According to the embodiment, only images having the same brightness are displayed during one sub-frame period. Therefore, each image can be accurately displayed while light emission of the backlight for one image does not influence the other image having different brightness.

That is, according to the embodiment, the dynamic range of the display element can be maximally used for each image and each image can be accurately displayed when the frame including the plurality of images is displayed on one screen.

In the embodiment, all the areas of the backlight emit light at the emission brightness value in accordance with the brightness of the image, but the present invention is not limited thereto. While only a partial area including the display area of the image may emit light at the emission brightness value in accordance with the brightness of the image, other areas may not emit light. However, when all the areas of the backlight emit light at the emission brightness value in accordance with the brightness of the image, the brightness (darkness) of the backlight around the image can be prevented from influencing the image.

In the embodiment, a case in which the display brightness setting value is the emission brightness value of the backlight, and the inputted image signal is prepared on the assumption that the backlight emits light with the display brightness setting value is described as an example, but the display brightness setting value or the inputted image signal is not limited thereto. The inputted image signal may be an image prepared on the assumption that the emission brightness of the backlight is fixed. In this case, the display brightness setting value may be a value indicating the brightness of the image such as a maximum value, a minimum value, a mean value, a mode value, and the like of a pixel value (a brightness value; a gradation value) of the image. The emission brightness value of the backlight is determined based on the display brightness setting value (for example, the emission brightness value is determined to increase as the mean brightness increases) and each pixel value may be corrected to compensate for a variation of the determined emission brightness value from a default value.

In the embodiment, the case in which the display area information is the positional coordinate of the pixel at each vertex (the upper left point, the upper right point, the lower left point, or the lower right point of the image) of the image is described as an example, but the display area information is not limited thereto. The display area information may be information indicating the display area of the image and may be information including, for example, the position of the image (for example, the position of one vertex or central position) and the size of the image (horizontal and vertical sizes of the image; the width and height of the image). The display area information may be coordinate data indicating the positions of two vertexes that have a diagonal positional relationship to each other in the image.

In the embodiment, the display brightness setting value and the display area information are inputted from the outside, but the information may be determined (generated) by analyzing the inputted image signal. For example, a rectangular edge is detected from the image signal and an area in the rectangular edge may be determined (detected) as one image area. A maximum value, a minimum value, a mean value, a mode value, and the like of the pixel value in one image area which is detected may be the display brightness setting value.

In the embodiment, the case in which the inputted frame includes two images is described as an example, but the frame is not limited thereto. The frame may include three or more images. Even in this case, the same processing as the processing described above may be performed. For example, when the frame includes four images Im1 to Im4 and the brightnesses of the four images Im1 to Im4 are different from each other, one frame period is divided into four sub-frame periods. The four images Im1 to Im4 are in sequence switched and displayed for each sub-frame period. When the frame includes the four images Im1 to Im4, the brightnesses of the images Im1 and Im3 are the same as each other, and the brightnesses of the images Im2 and Im4 are different from the brightnesses of other images, one frame period is divided into three sub-frame periods. The images Im1 and Im3, the image Im2, and the image Im4 are in sequence switched and displayed for each sub-frame period. That is, the images Im1 and Im3 are displayed during one sub-frame period.

Second Embodiment

Hereinafter, a liquid crystal display apparatus and a control method thereof according to a second embodiment of the present invention will be described with reference to the accompanying drawings. Further, hereinafter, features of the second embodiment different from those of the first embodiment will be described.

In the configuration of the first embodiment, the displayed image is switched for each brightness of the image, that is, only the images having the same brightness are concurrently displayed during one sub-frame period. Therefore, when the number of the images included in the frame is large, the length of one sub-frame period may be decreased. In the embodiment, a configuration in which the length of one sub-frame period can be larger than that of the first embodiment will be described. In the embodiment, the image is displayed by making the backlight of the area (partial area) including the display area of the image emit light at the emission brightness value in accordance with the brightness of the image.

Figure 6:
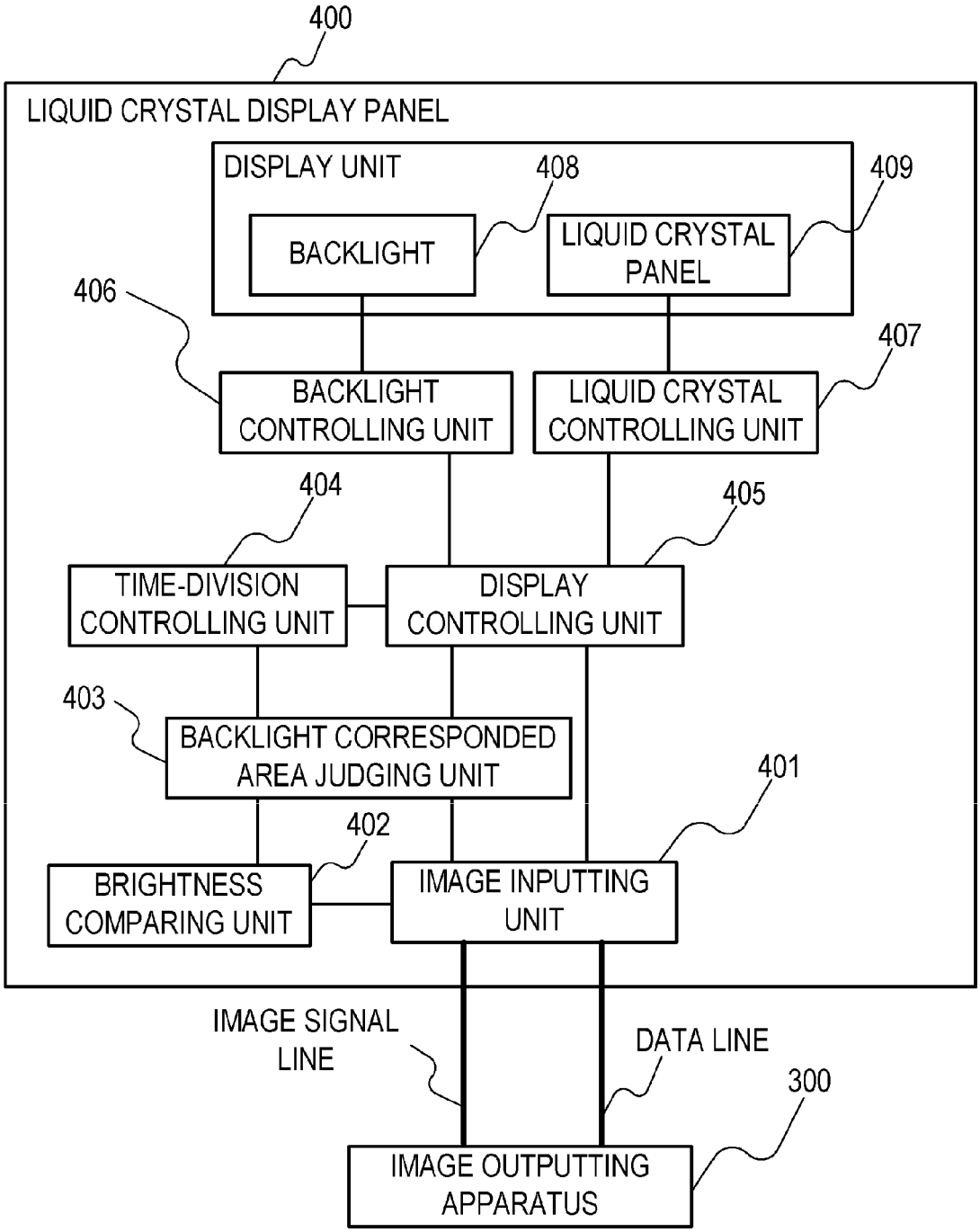
FIG. 6 is a block diagram illustrating one example of a schematic configuration of a liquid crystal display apparatus according to a second embodiment.

FIG. 6 is a block diagram illustrating one example of a schematic configuration of the liquid crystal display apparatus according to the second embodiment.

As illustrated in FIG. 6, the liquid crystal display apparatus 400 is connected to an image outputting apparatus 300. The liquid crystal display apparatus 400 includes an image inputting unit 401, a brightness comparing unit 402, a backlight corresponded area judging unit 403, a time-division controlling unit 404, a display controlling unit 405, a backlight controlling unit 406, a liquid crystal controlling unit 407, a backlight 408, and a liquid crystal panel 409.

The image outputting apparatus 300 is the same as the image outputting apparatus 100 of the first embodiment, and thus a description thereof will be omitted.

Next, an operation (processing) of each functional block of the liquid crystal display apparatus 400 will be described.

The image inputting unit 401 inputs the image signal for one frame. In detail, the image inputting unit 401 receives the image signal, the display brightness setting value, and the display area information from the image outputting apparatus 300. The image inputting unit 401 transmits the received display brightness setting value to the brightness comparing unit 402. The image inputting unit 401 transmits the received display brightness setting value and display area information to the backlight corresponded area judging unit 403. The image inputting unit 401 transmits the received image signal, display brightness setting value, and display area information to the display controlling unit 405.

The brightness comparing unit 402 receives the display brightness setting value from the image inputting unit 401. The brightness comparing unit 402 calculates the number n of different display brightness setting values from the received display brightness setting value and transmits the calculation result (the number n) to the backlight corresponded area judging unit 403.

When the inputted image signal for one frame is the signal of the frame including the plurality of images having different brightness, the backlight corresponded area judging unit 403 classifies the plurality of images into image groups in which the images are able to be displayed concurrently while light emissions of the backlights do not influence each other. In the embodiment, the plurality of images are classified into the image groups based on a difference in brightness between the images and a distance between the images.

In detail, the backlight corresponded area judging unit 403 receives the display brightness setting value and the display area information from the image inputting unit 401 and receives the number n of different display brightness setting values from the brightness comparing unit 402.

The backlight corresponded area judging unit 403 calculates a difference in the display brightness setting value and the distance between the images, from the display brightness setting value and the display area information of each image.

The backlight corresponded area judging unit 403 judges whether the images can be displayed at the same time (whether the images are accurately displayed when the images are displayed at the same time) by using the difference in the display brightness setting values and the distance between the images and a predetermined table. In detail, when the images are displayed at the same time by making the backlight emit light with the emission brightness values corresponding thereto, respectively, it is judged whether light emission of the backlight with respect to one image influences the other image.

The backlight corresponded area judging unit 403 judges an image group which can be displayed during the same sub-frame period based on the judgment result. In the embodiment, when the brightnesses of all the images included in the frame are different from each other, images which can be displayed at the same time among the images become the same image group. When the frame includes (the plurality of) images having the same brightness, all the images having the same brightness become the same image group. When all images having first brightness and all images having second brightness different from the first brightness may be concurrently displayed while the light emissions of the backlights do not influence each other, the images become the same image group.

The backlight corresponded area judging unit 403 calculates a value of "the number of the brightnesses (display brightness setting values) of the images included in the image group −1" for each image group and calculates the total value as the number m of display brightness setting values of images which can be displayed at the same time as an image having other display brightness setting value.

The backlight corresponded area judging unit 403 calculates the number n−m of image groups by subtracting the number m from the number n and transmits the calculated number n−m to the time-division controlling unit 404. The backlight corresponded area judging unit 403 transmits information (combination information) indicating the display brightness setting values of the images included in one image group to the display controlling unit 405.

The time-division controlling unit 404 receives the number n−m of the image groups from the backlight corresponded area judging unit 403. The time-division controlling unit 404 generates a time-division synchronization signal for dividing one frame period into sub-frame periods of n−m which is the number of image groups. The time-division controlling unit 404 transmits the time-division synchronization signal to the display controlling unit 405.

The display controlling unit 405, the backlight controlling unit 406, and the liquid crystal controlling unit 407 switch and display the image group for each sub-frame period.

In detail, the display controlling unit 405 receives the image signal, the display brightness setting value, and the display area information from the image inputting unit 401. The display controlling unit 405 receives the time-division synchronization signal from the time-division controlling unit 404. The display controlling unit 405 receives the combination information from the backlight corresponded area judging unit 403. The display controlling unit 405 allocates the display brightness setting values of the image displayed during n−m sub-frame periods divided by the time-division synchronization signal, respectively. In this case, the display controlling unit 405 allocates the display brightness setting values of the images included in the same image group to one sub-frame period from the combination information. The display controlling unit 405 generates a display image signal that allows an image corresponding to, during a sub-frame period, a display brightness setting value allocated to the sub-frame period to be displayed in an area designated by display area information corresponding to the image and a black color to be displayed in an area other than the corresponding area. The display controlling unit 405 transmits the generated display image signal to the liquid crystal controlling unit 407 and transmits the display brightness setting value and the display area information corresponding to the image displayed by the display image signal to the backlight controlling unit 406, during the sub-frame period.

The backlight controlling unit 406 receives the display brightness setting value and the display area information from the display controlling unit 405 during the sub-frame period. The backlight controlling unit 406 judges an area of the backlight 408 which emits light in order to display the image as an emission area based on the display area information of the image for each image. The backlight controlling unit 406 makes the backlight in the emission area of the image emit light with emission brightness depending on the display brightness setting value corresponding to the image for each image. Backlights of an area other than the emission area do not emit light.

The liquid crystal controlling unit 407 receives the display image signal from the display controlling unit 405 during the sub-frame period. The liquid crystal controlling unit 407 drives the liquid crystal panel 409 according to the display image signal.

Figure 7:
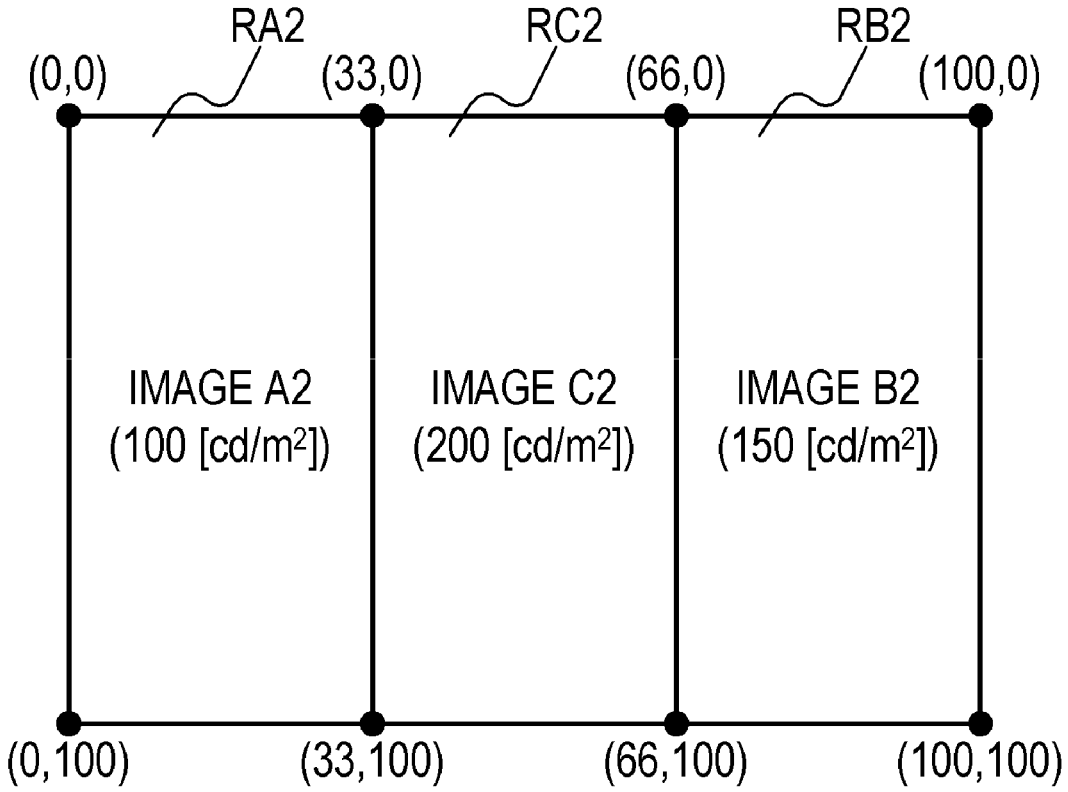
FIG. 7 is a diagram illustrating one example of an image signal, a display brightness setting value, and display area information.

FIG. 7 is a diagram illustrating one example of an image signal, a display brightness setting value, and display area information which are inputted. In the example of FIG. 7, the image signal is a signal of a frame including three images (images A2 to C2) which are aligned in the horizontal direction (in the horizontal direction of the screen). The image A2 is an image displayed in a left area RA2 of the screen, the image B2 is an image displayed in a right area RB2 of the screen, and the image C2 is an image displayed in the central area RC2 of the screen. In the example of FIG. 7, a display brightness setting value of the image A2 is 100 cd/m$^2$, a display brightness setting value of the image B2 is 150 cd/m$^2$, and a display brightness setting value of the image C2 is 200 cd/m$^2$. Display area information of the image A2 is four edge coordinates (0,0), (33,0), (0,100), and (33,100) of the area RA2. Display area information of the image B2 is four edge coordinates (66,0), (100,0), (66,100), and (100,100) of the area RB2. Display area information of the image C2 is four edge coordinates (33,0), (66,0), (33,100), and (66,100) of the area RC2.

Figure 8:
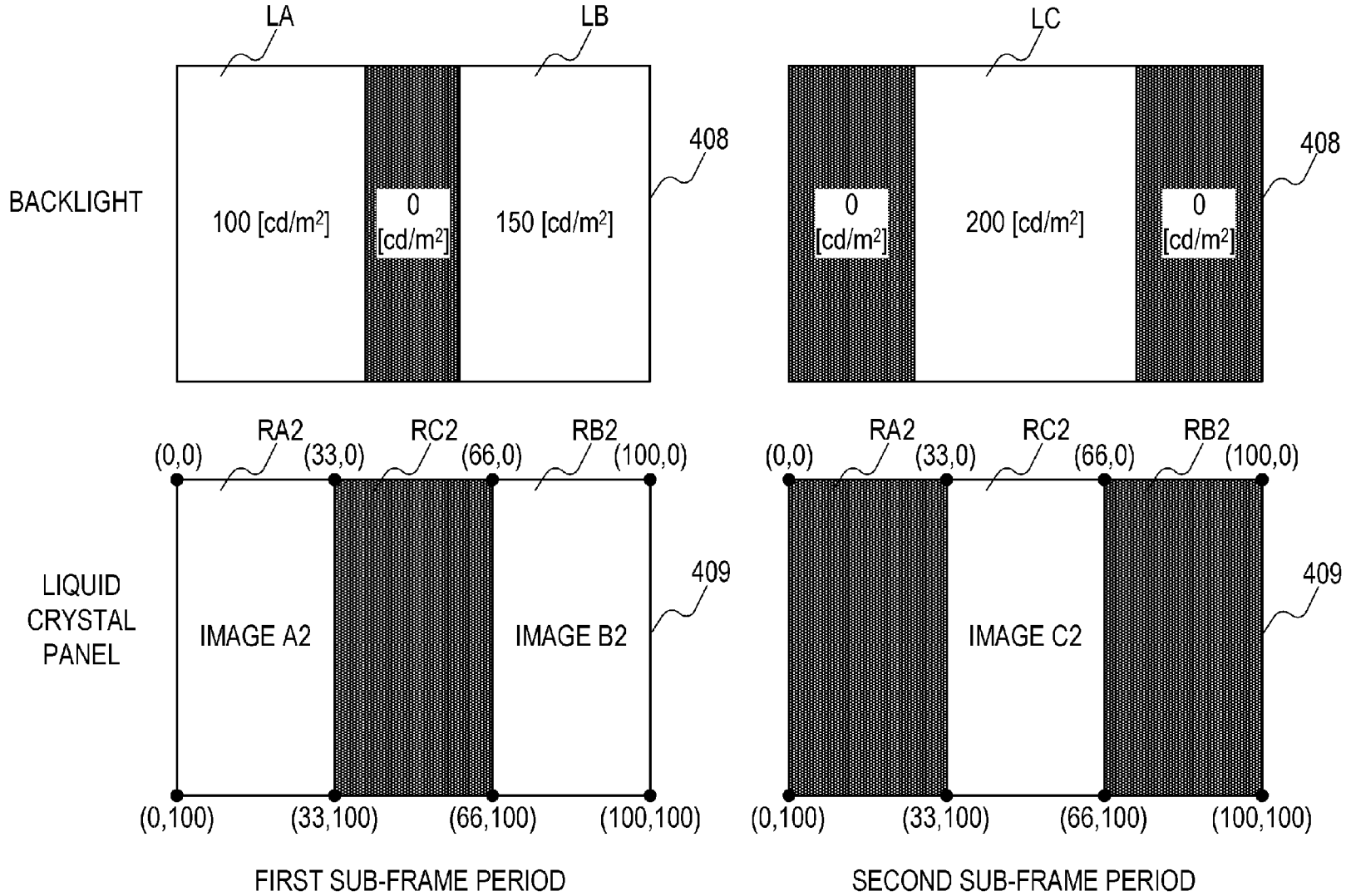
FIG. 8 is a diagram illustrating one example of a display image of the liquid crystal display apparatus according to the second embodiment.
Figure 9:
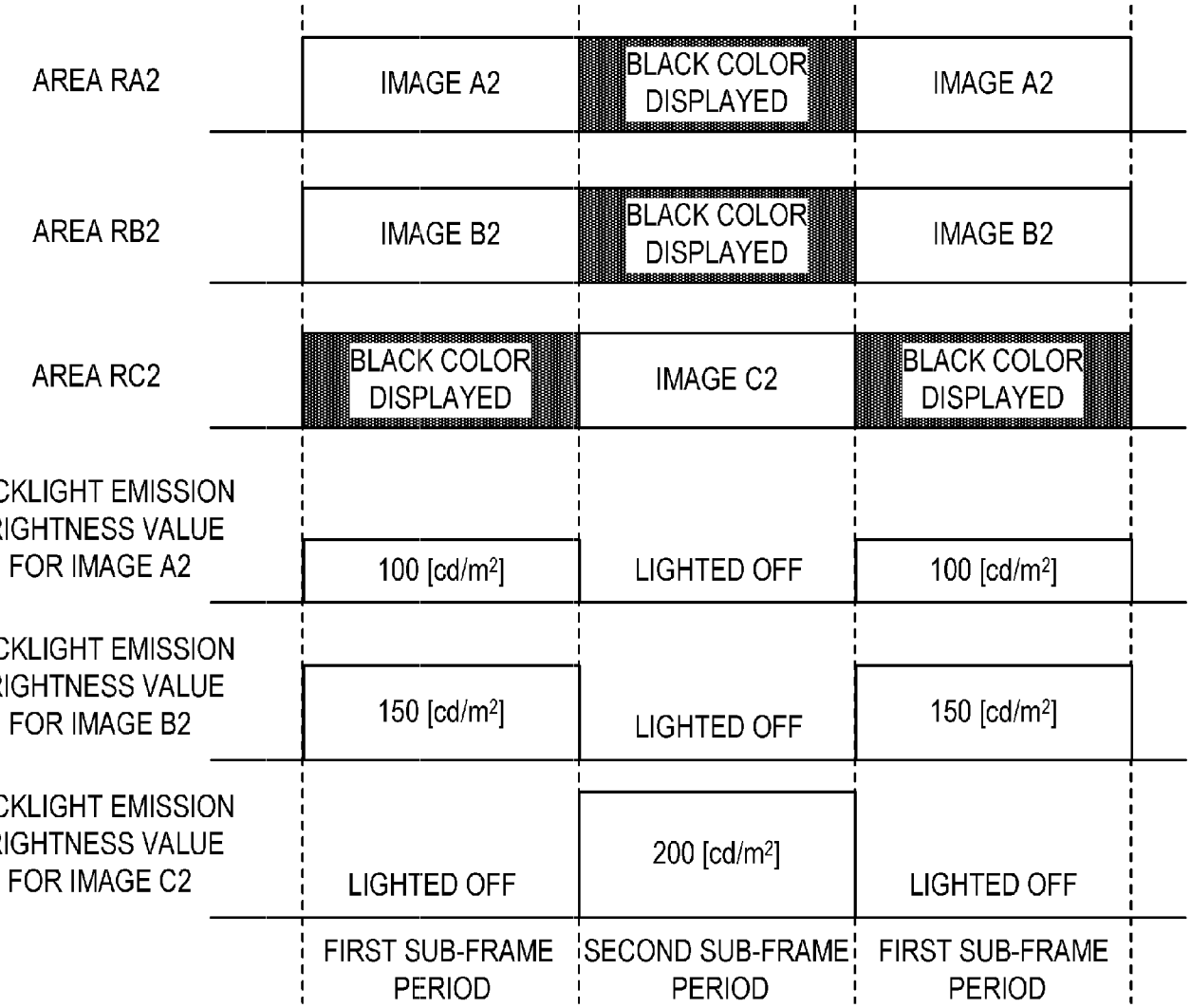
FIG. 9 is a time chart illustrating one example of an operation of the liquid crystal display apparatus according to the second embodiment.

When the image signal, the display brightness information, and the display area information of FIG. 7 are inputted, the number n of different display brightness setting values is 3. However, the image A2 and the image B2 are separated from each other and are able to be displayed concurrently (during the same subfield period) while light emissions of the backlights do not influence each other. Therefore, the image A2 and the image B2 become one image group and the image C2 becomes one image group. The number m of display brightness setting values of image groups of images which can be displayed at the same time as an image having other display brightness setting value and the number n−m are 1 and 2, respectively. As a result, one frame period is divided into two periods of the first sub-frame period and the second sub-frame period as illustrated in FIGS. 8 and 9. In the embodiment, a refresh rate (the number of display times of the image (frame) per one second) of the display unit (the backlight 408 and the liquid crystal panel 409) is set to 60 Hz and the length of one frame period is set to 16.66 ms. Therefore, both the lengths of the first sub-frame period and the second sub-frame period are 8.33 ms.

During the first sub-frame period, the image A2 is displayed in the area RA2, the image B2 is displayed in the area RB2, and the black color is displayed in the area RC2. In this case, the emission brightness of the backlight in an emission area LA for the image A2 is 100 cd/m$^2$ and the emission brightness of the backlight in an emission area LB for the image B2 is 150 cd/m$^2$. The emission brightness of the backlight in other areas is 0 cd/m$^2$ (lighted off). The emission area LA is separated from the area RB2 so that light of the backlight in the area LA does not influence the area RB2. Similarly, the emission area LB is separated from the area RA2 so that light of the backlight in the area LB does not influence the area RA2. Therefore, the image A2 and the image B2 are accurately displayed.

The black color is displayed in the areas RA2 and RB2 and the image C2 is displayed in the area RC2 during the second sub-frame period. In this case, the emission brightness of the backlight in the emission area LC for the image C is 200 cd/m$^2$. The emission brightness of the backlight in other areas is 0 cd/m$^2$ (lighted off).

Figure 10:
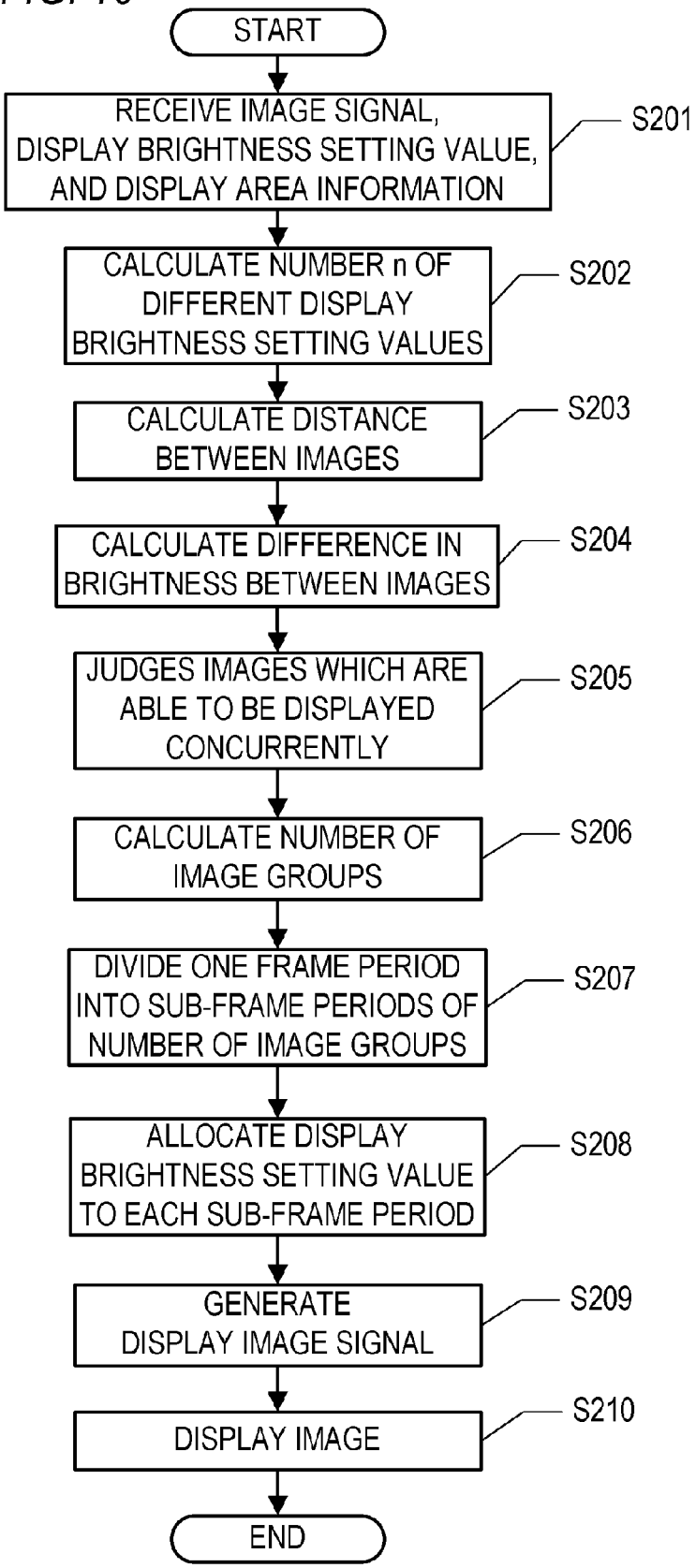
FIG. 10 is a flowchart illustrating one example of an operation of the liquid crystal display apparatus according to the second embodiment.

When the image signal, the display brightness setting value, and the display area information of FIG. 7 are inputted, an operation of the liquid crystal display apparatus 400 will be described by using a flowchart of FIG. 10.

In step S201, the image inputting unit 401 receives the image signal through the image signal line from the image outputting apparatus 300 and receives the display brightness setting value and the display area information through the data line. The image inputting unit 401 transmits the received display brightness setting value to the brightness comparing unit 402, transmits the received image signal, display brightness setting value, and display area information to the display controlling unit 405, and transmits the received display brightness setting value and display area information to the backlight corresponded area judging unit 403.

In step S202, the brightness comparing unit 402 receives the display brightness setting value from the image inputting unit 401. The brightness comparing unit 402 calculates the number n of different display brightness setting values from the received display brightness setting value and transmits the calculation result (the number n) to the backlight corresponded area judging unit 403.

The processing of step S202 will be described in detail.

First, the brightness comparing unit 402 receives the display brightness setting value of the image A2, the display brightness setting value of the image B2, and the display brightness setting value of the image C2 as the display brightness setting value, and judges that the number a of the received display brightness setting values is 3.

Next, the brightness comparing unit 402 judges that the number of combinations of two display brightness setting values is three because a=3. The brightness comparing unit 402 calculates a difference between two display brightness setting values of the combination and updates the number b of the same display brightness setting values as the display brightness setting value of other image, with respect to each of the three combinations. First, a difference between the display brightness setting value of the image A2 and the display brightness setting value of the image B2 of 50 cd/m$^2$ (alternatively, −50 cd/m$^2$) which is not 0 is calculated, and 0 is added to b. Next, a difference between the display brightness setting value of the image A2 and the display brightness setting value of the image C2 of 100 cd/m$^2$ (alternatively, −100 cd/m$^2$) which is not 0 is calculated, and 0 is added to b. Last, a difference between the display brightness setting value of the image B2 and the display brightness setting value of the image C2 of 50 cd/m$^2$ (alternatively, −50 cd/m$^2$) which is not 0 is calculated, and 0 is added to b. As a result, a final value of b is 0.

The brightness comparing unit 402 calculates the number n of different display brightness setting values which is 3 at (a−b)=3−0 and transmits the calculation result (the number n of different display brightness setting values is 3) to the backlight corresponded area judging unit 403.

In step S203, the backlight corresponded area judging unit 403 receives the display brightness setting value and the display area information from the image inputting unit 401 and receives the number n of different display brightness setting values which is 3 from the brightness comparing unit 402. The backlight corresponded area judging unit 403 calculates a distance between the images from the display area information. In the embodiment, as the distance between the images, a distance between pixels which are the closest is calculated.

Hereinafter, an example of a calculation method of the distance between the images will be described.

First, the backlight corresponded area judging unit 403 acquires a minimum value and a maximum value of an x coordinate and a minimum value and a maximum value of a y coordinate of a display area of an image from display area information of the image for each image. Herein, as a minimum value of an x coordinate (an x-coordinate minimum value) of the image A2, xmin=0, as a maximum value of an x coordinate (an x-coordinate maximum value) of the image A2, xmax=33, as a minimum value of a y coordinate (a y-coordinate minimum value) of the image A2, ymin=0, and as a maximum value of a y coordinate (a y-coordinate maximum value) of the image A2, ymax=100. As a minimum value of an x coordinate of the image B2, xmin=66, as a maximum value of an x coordinate of the image B2, xmax=100, as a minimum value of a y coordinate of the image B2, ymin=0, and as a maximum value of a y coordinate of the image B2, ymax=100. As a minimum value of an x coordinate of the image C2, xmin=33, as a maximum value of an x coordinate of the image C2, xmax=66, as a minimum value of a y coordinate of the image C2, ymin=0, and as a maximum value of a y coordinate of the image C2, ymax=100.

Next, the backlight corresponded area judging unit 403 calculates the distance between the images by using the x-coordinate minimum value, the x-coordinate maximum value, the y-coordinate minimum value, and the y-coordinate maximum value of each image.

In detail, the backlight corresponded area judging unit 403 subtracts an x-coordinate maximum value of an image of which an x-coordinate minimum value is small, from an x-coordinate minimum value of an image of which an x-coordinate minimum value is large between two images in which a distance therebetween is calculated, and acquires a distance in an x-coordinate direction between the two images. Herein, the backlight corresponded area judging unit 403 sets the x coordinate-direction distance to 0 when the x-coordinate minimum values of the two images are the same as each other. When a value of the x coordinate-direction distance is negative, the distance value is substituted by 0.

The backlight corresponded area judging unit 403 subtracts an y-coordinate maximum value of an image of which a y-coordinate minimum value is small, from a y-coordinate minimum value of an image of which a y-coordinate minimum value is large between two images in which a distance therebetween is calculated, and acquires a distance in a y-coordinate direction between the two images. Herein, the backlight corresponded area judging unit 403 sets the y coordinate-direction distance to 0 when the y-coordinate minimum values of the two images are the same as each other. When a value of the y coordinate-direction distance is negative, the distance value is substituted by 0.

The backlight corresponded area judging unit 403 calculates a square root of the sum of the square of the x coordinate-direction distance and the square of the y coordinate-direction distance as the distance between the images.

In the calculation method, the x coordinate-direction distance and the y coordinate-direction distance between the images A2 and C2 are 0 and 0, respectively, and a distance between the images A2 and C2 is 0.

The x coordinate-direction distance and the y coordinate-direction distance between the images B2 and C2 are 0 and 0, respectively, and a distance between the images B2 and C2 is 0.

The x coordinate-direction distance and the y coordinate-direction distance between the images A2 and B2 are 33 and 0, respectively, and a distance between the images A2 and B2 is 33.

In step S204, the backlight corresponded area judging unit 403 calculates a difference in brightness (a difference in the display brightness setting values) between images in which a distance therebetween is not 0. Herein, a difference (50 cd/m$^2$ or −50 cd/m$^2$) between the display brightness setting value of the image A2 which is 100 cd/m$^2$ and a display brightness setting value of the image B2 which is 150 cd/m$^2$ is calculated.

In step S205, the backlight corresponded area judging unit 403 judges whether the images can be concurrently displayed by using the distance between the images, the difference in the display brightness setting value between the images, and a predetermined table. The table indicates, for example, whether images of combinations can be concurrently displayed for each of the combinations of the distance (alternatively, a range of the distance) and a difference (alternatively, a range of the difference in the display brightness setting values) in the display brightness setting values between the images. The backlight corresponded area judging unit 403 judges that two images in which the distance therebetween is 0 may not be displayed concurrently.

In the embodiment, it is judged that the images A2 and B2 may be displayed concurrently and it is judged that the images A2 and C2 and the images B2 and C2 may not be displayed concurrently.

In step S206, the backlight corresponded area judging unit 403 calculates the number of image groups and transmits the calculated number to the time-division controlling unit 404. The backlight corresponded area judging unit 403 transmits the combination information to the display controlling unit 405.

In detail, the backlight corresponded area judging unit 403 judges an image group which can be displayed during the same sub-frame period based on the judgment result in step S205. Herein, as described above, the image A2 having the display brightness setting value of 100 cd/m$^2$ and the image B2 having the display brightness setting value of 150 cd/m$^2$ may be displayed concurrently. Therefore, it is judged that the image A2 and the image B2 are one image group and it is judged that the image C2 is one image group. With respect to the image group including the images A2 and B2, the number of brightnesses of the images included in the image group −1=2−1=1 is calculated. With respect to the image group including the image C2, the number of brightnesses of the images included in the image group −1=1−1=0 is calculated. The total sum (1+0=1) of the calculated values is calculated as the number m of display brightness setting values of images which can be displayed at the same time as an image having other display brightness setting value.

When it is judged that all the images A2 to C2 cannot be displayed at the same time as other images, it is judged that the respective images A2 to C2 are different image groups and values of the respective image groups (the number of brightnesses of the images included in the image group −1) are all 0. Therefore, m=0 is calculated.

The backlight corresponded area judging unit 403 calculates the number n−m=3−1=2 of image groups by subtracting the number m=1 from the number n=3 and transmits the calculated number to the time-division controlling unit 404.

The backlight corresponded area judging unit 403 transmits information indicating the display brightness setting value of 100 cd/m$^2$ and the display brightness setting value 150 cd/m$^2$ as the combination information of the image groups including the images A2 and B2 to the display controlling unit 405. The backlight corresponded area judging unit 403 transmits information indicating the display brightness setting value of 200 cd/m$^2$ as the combination information of the image groups including the image C2 to the display controlling unit 405.

In step S207, the time-division controlling unit 404 receives the number n−m of the image groups which is 2 from the backlight corresponded area judging unit 403. The time-division controlling unit 404 generates a time-division synchronization signal for dividing one frame period into sub-frame periods of the number n−m of image groups which is 2. The time-division controlling unit 404 transmits the time-division synchronization signal to the display controlling unit 405.

In step S208, the display controlling unit 405 receives the image signal, the display brightness setting value, and the display area information from the image inputting unit 401. The display controlling unit 405 receives the combination information from the backlight corresponded area judging unit 403. The display controlling unit 405 receives the time-division synchronization signal from the time-division controlling unit 404. The display controlling unit 405 allocates the display brightness setting value of 100 cd/m$^2$ and the display brightness setting value of 150 cd/m$^2$ to the first sub-frame period and the display brightness setting value of 200 cd/m$^2$ to the second sub-frame period. That is, the display periods of the image A2 having the display brightness setting value of 100 cd/m$^2$ and the image B2 having the display brightness setting value of 150 cd/m$^2$ become the first sub-frame period and the display period of the image B2 having the display brightness setting value of 200 cd/m$^2$ becomes the second sub-frame period.

In step S209, the display controlling unit 405 generates a display image signal that allows the images A2 and B2 to be displayed in the area designated by the display area information corresponding to the images A2 and B2 and the black color to be displayed in the area other than the corresponding area, during the first sub-frame period. The display controlling unit 405 transmits the generated display image signal to the liquid crystal controlling unit 407 and transmits the display brightness setting values and the display area information corresponding to the images A2 and B2 to the backlight controlling unit 406, during the first sub-frame period.

A display image signal that allows the image C2 to be displayed in the area designated by the display area information corresponding to the image C2 and the black color to be displayed in the area other than the corresponding area, is generated during the second sub-frame period. During the second sub-frame period, the generated display image signal is transmitted to the liquid crystal controlling unit 407 and the display brightness setting value and the display area information corresponding to the image C2 are transmitted to the backlight controlling unit 406.

In step S210, the backlight controlling unit 406 receives the display brightness setting value and the display area information from the display controlling unit 405. The backlight controlling unit 406 judges the emission area based on the display area information of the image for each image. In detail, during the first sub-frame period, an area including the area of the image A2 becomes the emission area LA of the image A2 and an area including the area of the image B2 becomes the emission area LB of the image B2. The backlight controlling unit 406 makes the backlight in the emission area of the image emit light with the emission brightness depending on the display brightness setting value corresponding to the image for each image. In detail, during the first sub-frame period, the emission area LA emits light at 100 cd/m$^2$ and the emission area LB emits light at 150 cd/m$^2$. Areas other than the emission area LA and the emission area LB do not emit light.

The liquid crystal controlling unit 407 drives the liquid crystal panel according to the display image signal transmitted from the display controlling unit 405.

As a result, during the first sub-frame period, the image A2 is displayed in the area RA2, the image B2 is displayed in the area RB2, and the black color is displayed in other areas. The image C2 is displayed in the area RC2 and the black color is displayed in other areas, during the second sub-frame period.

As described above, according to the embodiment, the plurality of images having different brightness are classified into the image groups in which the images are able to be displayed concurrently while light emissions of the backlights do not influence each other. One frame period is divided into sub-frame periods of the number of image groups and the image group is switched and displayed for each sub-frame period. That is, according to the embodiment, when the images are separated from each other not to influence each other even though the images have different brightness, the images become one image group displayed during one sub-frame period. Therefore, as compared with the first embodiment, the number of sub-frame periods can decrease and the length of one sub-frame period can increase.

As described above, since the plurality of images included in one image group are separated from each other not to influence each other, all the plurality of images can be accurately displayed. Therefore, even in the configuration of the embodiment, the same effect as the first embodiment can be acquired.

The emission area may have the same size as the area of the image or a size larger than the area of the image. For example, the emission area may be a larger area as large as the predetermined number of pixels (for example, 5, 10, and 15 pixels) than the area of the image in a horizontal direction and a vertical direction. In the example of FIG. 7, since a large area may be set at only a right side of the area of the image A, an area acquired by combining the area of the image A and an area of a 5 right pixel width of the area becomes the emission area LA. Since a large area may be set in only a right side and a left side of the area of the image C, an area acquired by combining the area of the image C, the area of a 5 right pixel width of the area, and an area of a 5 left pixel width of the area becomes the emission area LC. By setting an area larger than the area of the image as the emission area, the brightness (darkness) of the backlight around the image can be prevented from influencing the image.

A ratio of the size of the emission area to the size of the image area may vary depending on the image. For example, the size of the emission area may be determined so that the ratio of the size of the emission area to the area size of the image increases as the image is dark. The size of the emission area of the image may be determined for each image by using a predetermined table (a table indicating a corresponding relationship between the brightness of the image and the size of the emission area). It is considered that a dark image (an image displayed with a small emission brightness value of the backlight) is more easily influenced by the brightness (darkness) of the surrounding backlight than a bright image. Therefore, by the above configuration, the brightness (darkness) of the backlight around the image can be effectively prevented from influencing the image.

In the embodiment, the plurality of images are classified into the image groups based on the difference in brightness between the images and the distance between the images, but the present invention is not limited to the configuration. When the images are separated from each other to some extent, the images can be displayed concurrently without influencing each other regardless of the difference in brightness between the images. Therefore, the plurality of images may be classified into the image group by using only the distance between the images. However, the plurality of images can be classified into the image group more precisely by considering the brightness of the image.

In the embodiment, the combination information of the respective image groups is transmitted to the display controlling unit 405, but when only an image having one display brightness setting value is included in the image group, the combination information of the image group may not be transmitted. In this case, all images having one brightness may be judged as one image group with respect to images having brightness (display brightness setting value) which is not indicated as the combination information. That is, for each display brightness setting value not indicated as the combination information, all images having the display brightness setting value may be judged as one image group.

In the embodiment, it is judged whether all the combinations of two images can be displayed concurrently, but the present invention is not limited to the configuration. The configuration may be a configuration in which it is judged whether an image having the first brightness and an image having the second brightness which are the closest can be displayed concurrently among all images having the first brightness and all images having the second brightness. In this case, when the image having the first brightness and the image having the second brightness which are the closest can be displayed concurrently, all the images having the first brightness and all the images having the second brightness may be set as images in the same image group.

In the embodiment, the case in which the inputted frame includes each one image having each brightness is described as the example, but the frame is not limited thereto. The frame may include a plurality of images having one brightness. Even in this case, the same processing as described above may be performed. For example, the case in which the frame includes four images Im1 to Im4, the brightnesses of the images Im1 and Im3 are the same as each other, and the brightnesses of the images Im2 and Im4 are different from the brightnesses of other images is considered. Herein, when the image Im1, the image Im3, and the image Im2 may be displayed concurrently, the images Im1 to Im3 become one image group and the image Im4 becomes one image group. The images Im1 to Im3 and the image Im4 are in sequence switched and displayed for each sub-frame period. That is, the images Im1 to Im3 are displayed during one sub-frame period.

Third Embodiment

Hereinafter, the third embodiment of the present invention will be described with reference to the accompanying drawings.

In the embodiment, an example of a case in which a signal of a frame including more images than those of FIG. 7 is inputted into the liquid crystal display apparatus of the second embodiment will be described.

Each function of the liquid crystal display apparatus according to the embodiment is the same as that of the second embodiment, and thus a description thereof will be omitted. Hereinafter, a detailed example of the image signal and a classification result of the image group will be described.

Figure 11:
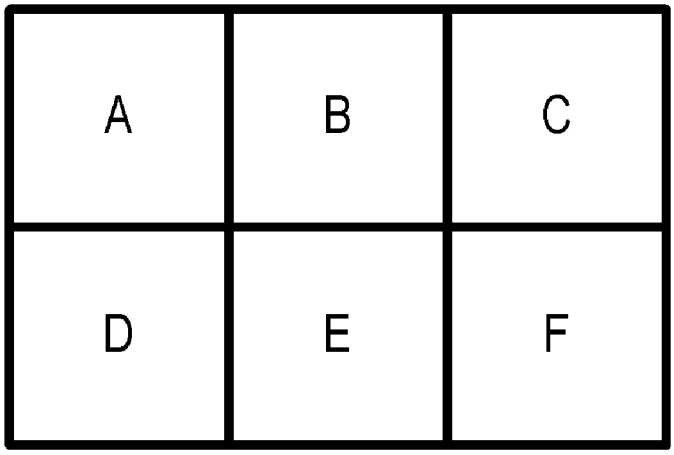
FIG. 11 is a diagram illustrating one example of an image signal according to a third embodiment.

FIG. 11 is a diagram illustrating one example of an inputted image signal.

In the example of FIG. 11, the image signal is a signal of a frame including six (2×3) images (images A to F). In detail, in the example of FIG. 11, the images A to C are positioned in line sequentially from the left on a first line and the images D to F are positioned in line sequentially from the left on a second line. Herein, the respective images have different brightness. Each image influences only a neighboring image. That is, two images is significantly separated from each other with one image interposed therebetween and light emissions of the backlights do not influence (interfere in) each other.

In the example of FIG. 11, the images A to F are classified into four image groups as illustrated in FIGS. 12A and 12B. In FIGS. 12A and 12B, a numerical value allocated to each image represents the number of the image group. That is, images having the same allocated numerical value are included in the same image group. In an example of FIG. 12A, the images A to F are classified into four image groups of an image group including the images A and C, an image group including the images D and F, an image group including the image B, and an image group including the image E. In an example of FIG. 12B, the images A to F are classified into four image groups of an image group including the images A and F, an image group including the images C and D, an image group including the image B, and an image group including the image E.

Figure 13A:
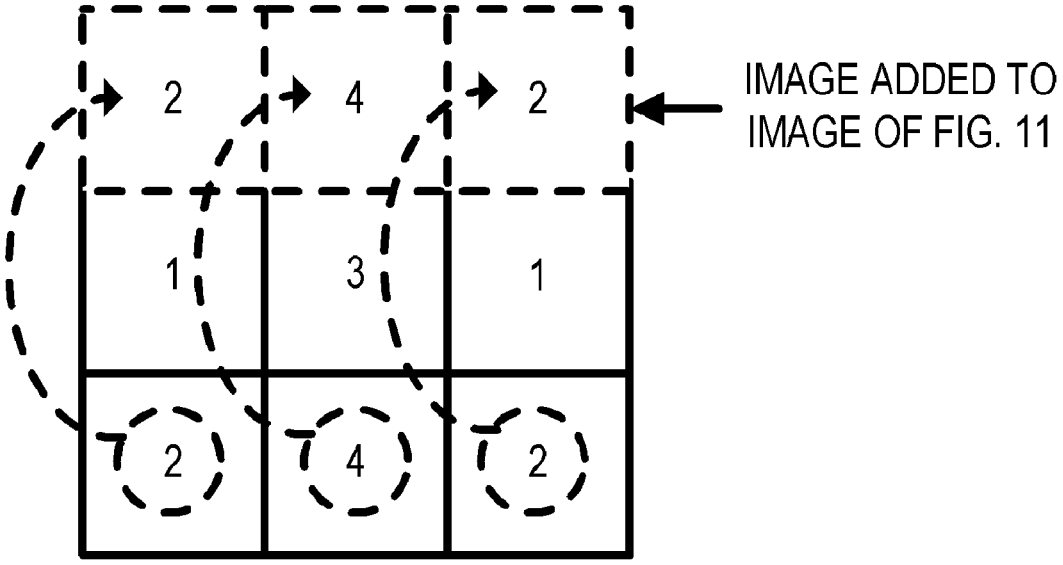
FIGS. 13A and 13B are diagrams illustrating one example of a method of classifying an image group according to the third embodiment.
Figure 13B:
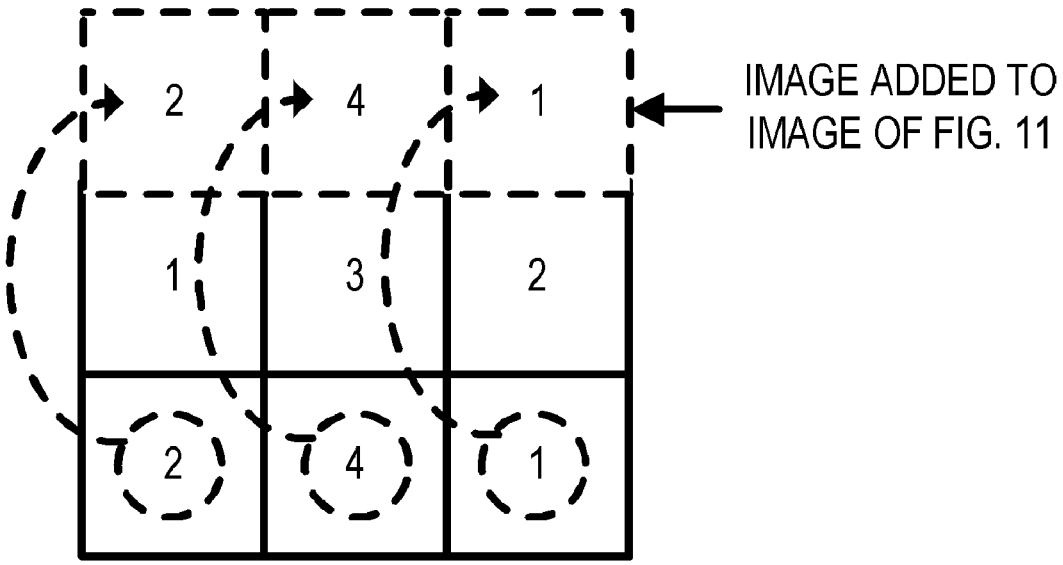

When the image signal is a signal of a frame including nine (3×3) images, nine images are classified into, for example, four image groups, as illustrated in FIGS. 13A and 13B. In detail, when images increase above six images of FIG. 11, the increased images become the same image group as an image positioned former by two in a reverse direction (downward) to the increasing direction (upward). That is, when the images increase above six images of FIG. 11, the increased images become the same image group as an image positioned below the image by two.

Figure 14A:
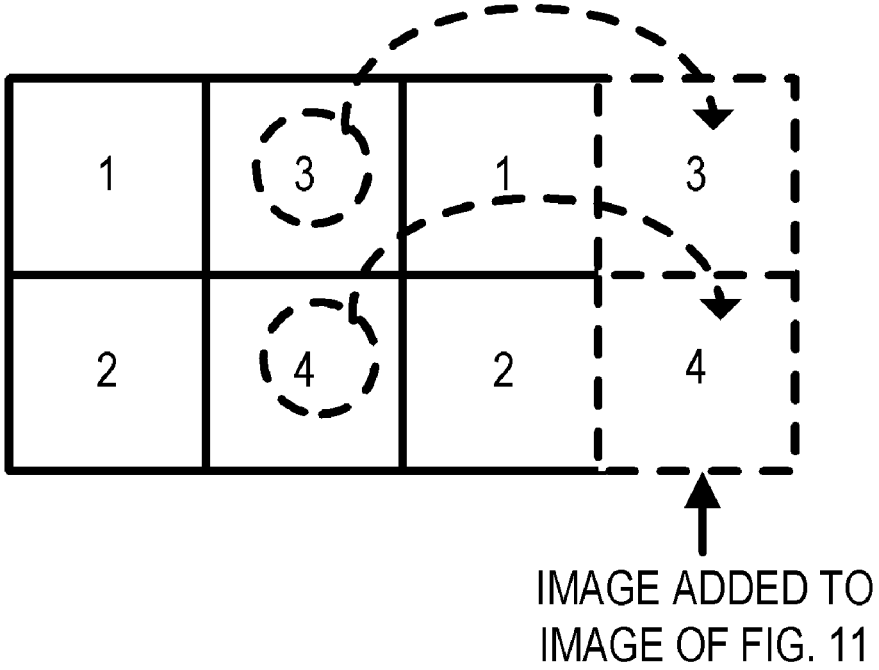
FIGS. 14A and 14B are diagrams illustrating one example of a method of classifying an image group according to the third embodiment.
Figure 14B:
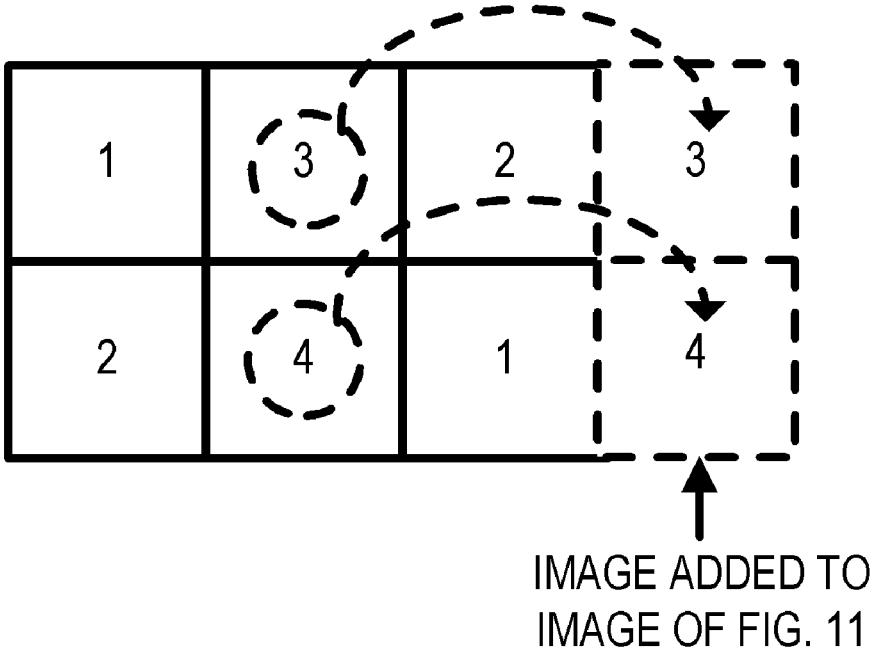

When the image signal is a signal of a frame including eight (2×4) images, eight images are classified into, for example, four image groups, as illustrated in FIGS. 14A and 14B. In detail, when images increase at the right side of six images of FIG. 11, the increased images become the same image group as an image positioned former by two in a reverse direction (left direction) to the increasing direction (right direction). That is, when the images increase at the right side of six images of FIG. 11, the increased images become the same image group as an image positioned at the left side of the image by two.

As described above, according to the embodiment, the number of image groups can be prevented to four or less. Therefore, the length of one sub-frame period can increase as compared with the configuration of the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-181198, filed on Aug. 23, 2011, which is hereby incorporated by reference herein in its entirety.

What is claimed is:

1. A display apparatus that displays an image by causing a light-emitting unit to emit light at an emission brightness value in accordance with brightness of the image, the display apparatus comprising:

an input unit that inputs image data;

a division unit that divides one frame period into a plurality of sub-frame periods when one frame of the image data includes a plurality of images having different brightness; and a display controlling unit that performs control of switching between the plurality of images for each sub-frame period and displaying the images, wherein the division unit classifies the plurality of images into image groups based on a distance between the images, when one frame of the image data includes the plurality of images having different brightness, and divides one frame period into sub-frame periods of the number of image groups, and in the control, the image groups are switched therebetween to be displayed for each sub-frame period.

2. The display apparatus according to claim 1, wherein the display controlling unit causes an entire area of a light-emitting unit to emit light at the emission brightness value in accordance with the brightness of the image to be displayed at the time of performing the control.

3. The display apparatus according to claim 1, wherein the display controlling unit causes only a partial light-emitting unit area including a display area of the image to emit light at the emission brightness value in accordance with the brightness of the image to be displayed at the time of performing the control.

4. The display apparatus according to claim 1, wherein the display controlling unit performs the control to display images having the same brightness during one sub-frame period when one frame of the image signal data includes the images having the same brightness.

5. The display apparatus according to claim 1, wherein the display apparatus displays the image by causing a light-emitting unit of an area including the display area of the image to emit light at the emission brightness value in accordance with the brightness of the image, and the division unit classifies the plurality of images into image groups in which the images are able to be displayed concurrently while light emissions of light-emitting units do not influence each other, based on a distance between the images, when one frame of the image data includes the plurality of images having different brightness, and divides one frame period into sub-frame periods of the number of image groups.

6. The display apparatus according to claim 1, wherein the division unit sets all the images having the same brightness as the same image group when one frame of the image data includes the images having the same brightness, and when one frame of the image data includes the images having the same brightness, and all images having first brightness and all images having second brightness different from the first brightness are able to be displayed concurrently while the light emissions of the light-emitting units do not influence each other, the division unit sets the images as the same image group.

7. The display apparatus according to claim 1, wherein the division unit classifies the plurality of images into the image groups based on a difference in brightness between the images and a distance between the images.

8. The display apparatus according to claim 1, wherein the display controlling unit causes a light-emitting unit in an area larger than an area of the image to emit light at the emission brightness value in accordance with the brightness of the image to be displayed at the time of performing the control.

9. A control method of a display apparatus that displays an image by causing a light-emitting unit to emit light at an emission brightness value in accordance with brightness of the image, the method comprising:

an input step of inputting image data;

a division step of dividing one frame period into a plurality of sub-frame periods when one frame of the image data includes a plurality of images having different brightness; and a display controlling step of performing a control of switching between the plurality of images for each sub-frame period and displaying the images, wherein in the division step, the plurality of images are classified into image groups based on a distance between the images, when one frame of the image data includes the plurality of images having different brightness and one frame period is divided into sub-frame periods of the number of image groups, and in the control, the image groups are switched therebetween to be displayed for each sub-frame period.

10. The control method of a display apparatus according to claim 9, wherein in the display controlling step, an entire area of a light-emitting unit emits light at the emission brightness value in accordance with the brightness of the image to be displayed when the control is performed.

11. The control method of a display apparatus according to claim 9, wherein in the display controlling step, only a partial light-emitting unit area including a display area of the image emits light at the emission brightness value in accordance with the brightness of the image to be displayed when the control is performed.

12. The control method of a display apparatus according to claim 9, wherein the control is performed such that in the display controlling step, images having the same brightness are displayed during one sub-frame period when one frame of the image data includes the images having the same brightness.

13. The control method of a display apparatus according to claim 9, wherein the display apparatus displays the image by causing a light-emitting unit of an area including the display area of the image to emit light at the emission brightness value in accordance with the brightness of the image, and in the division step, the plurality of images are classified into image groups in which the images are able to be displayed concurrently while light emissions of light-emitting units do not influence each other, based on a distance between the images, when one frame of the image data includes the plurality of images having different brightness and one frame period is divided into sub-frame periods of the number of image groups.

14. The control method of a display apparatus according to claim 9, wherein in the division step, all the images having the same brightness are set as images in the same image group when one frame of the image data includes the images having the same brightness, and when one frame of the image data includes the images having the same brightness, and all images having first brightness and all images having second brightness different from the first brightness are able to be displayed concurrently while the light emissions of the light-emitting units do not influence each other, the images are set as images in the same image group.

15. The control method of a display apparatus according to claim 9, wherein in the division step, the plurality of images are classified into the image groups based on a difference in brightness between the images and a distance between the images.

16. The control method of a display apparatus according to claim 9, wherein in the display controlling step, a light-emitting unit in an area larger than an area of the image emits light at the emission brightness value in accordance with the brightness of the displayed image when the control is performed.

* * * * *